US010086388B2

(12) United States Patent
Gopalan et al.

(10) Patent No.: US 10,086,388 B2
(45) Date of Patent: Oct. 2, 2018

(54) RAIN-CAN STYLE SHOWERHEAD ASSEMBLY INCORPORATING EDDY FILTER FOR FLOW CONDITIONING IN FLUIDIC CIRCUITS

(71) Applicant: DLHBOWLES, INC., Canton, OH (US)

(72) Inventors: Shridhar Gopalan, Westminster, MD (US); Gregory Russell, Catonsville, MD (US)

(73) Assignee: DLHBOWLES, INC., Canton, OH (US)

( * ) Notice: Subject to any disclaimer, the term of this patent is extended or adjusted under 35 U.S.C. 154(b) by 0 days.

(21) Appl. No.: 14/577,020

(22) Filed: Dec. 19, 2014

(65) Prior Publication Data

US 2015/0165451 A1 Jun. 18, 2015

Related U.S. Application Data

(62) Division of application No. 12/845,679, filed on Jul. 28, 2010, now abandoned.

(60) Provisional application No. 61/229,227, filed on Jul. 28, 2009.

(51) Int. Cl.
*B05B 1/18* (2006.01)
*B05B 1/08* (2006.01)

(52) U.S. Cl.
CPC ..... *B05B 1/185* (2013.01); *B05B 1/08* (2013.01)

(58) Field of Classification Search
CPC .... B05B 1/02; B05B 1/04; B05B 1/08; B05B 1/18; B05B 1/185
USPC ..... 239/553–553.5, 562, 589.1, 592, 594
See application file for complete search history.

(56) References Cited

U.S. PATENT DOCUMENTS

| | | | | |
|---|---|---|---|---|
| 7,677,480 | B2 * | 3/2010 | Russell | B05B 1/08 137/833 |
| 8,205,812 | B2 * | 6/2012 | Hester | B05B 1/08 137/814 |
| 2006/0108442 | A1 * | 5/2006 | Russell | B05B 1/08 239/102.1 |
| 2010/0072307 | A1 * | 3/2010 | Hester | B05B 1/08 239/589.1 |

* cited by examiner

*Primary Examiner* — Christopher Kim
(74) *Attorney, Agent, or Firm* — McDonald Hopkins LLC

(57) ABSTRACT

A fluidic oscillator adapted for use in a showerhead or nozzle assembly includes an eddy filter structure which reduces the adverse effects of fluid supply turbulence on the fluidic oscillator's spraying performance. A nozzle or rain can style showerhead assembly includes a water chamber or manifold which receives water via a central inlet fitting. Water entering the water chamber or manifold flows turbulently into and through the manifold and is expelled under pressure through a plurality of nozzles which are configured as specially adapted fluidic inserts.

18 Claims, 5 Drawing Sheets

FIG. 5
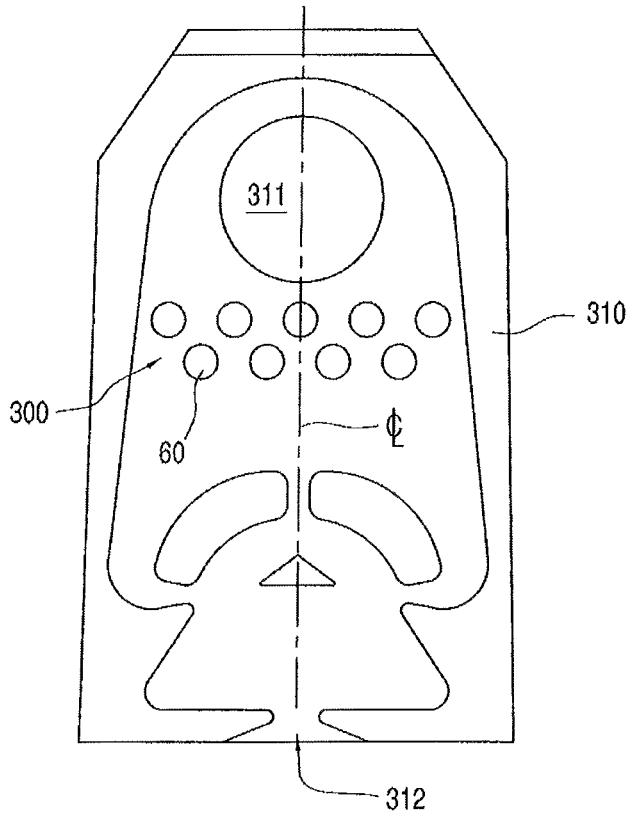
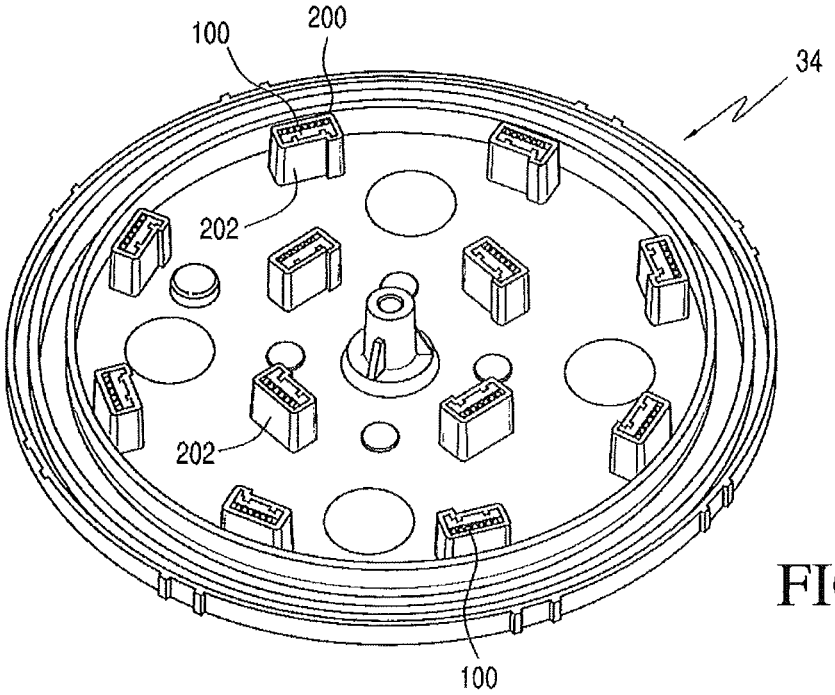
FIG. 6

RAIN-CAN STYLE SHOWERHEAD ASSEMBLY INCORPORATING EDDY FILTER FOR FLOW CONDITIONING IN FLUIDIC CIRCUITS

PRIORITY CLAIM AND REFERENCE TO RELATED APPLICATIONS

This application is a Divisional application for copending U.S. non-provisional application Ser. No. 12/845,679. This application claims priority to related and commonly owned U.S. patent application Ser. No. 12/845,679, filed Jul. 28, 2010, the entire disclosures of which are also incorporated herein by reference. This application also claims priority to related and commonly owned U.S. provisional patent application No. 61/229,227, filed Jul. 28, 2009, the entire disclosure of which is incorporated herein by reference. This application is also commonly owned with U.S. Pat. Nos. 4,122,845 and 7,111,800 which relate to personal spray devices incorporating fluidic oscillating circuits, the entire disclosures of which are also incorporated herein by reference.

BACKGROUND OF THE INVENTION

Field of the Invention

The present invention relates to structures and methods for reliably generating a desired spray pattern, and, more particularly, to a showerhead that distributes water from a large showerhead front surface area. Showerheads of this type are sometimes referred to as "rain showers" or "rain can" showerheads.

Discussion of the Prior Art

A shower head is typically a perforated nozzle that generates a plurality of water jets and distributes sprayed water over a large solid angle. In water conserving designs, less water is used to shower or wet a given area. Low flow shower heads can use water more efficiently by aerating the water stream. Some shower heads can be adjusted to spray different patterns of water. Hard water may result in calcium and magnesium deposits clogging the head, reducing the flow and changing the spray pattern. Persons of skill in the art will appreciate that these design issues and many others are described in U.S. Pat. No. 7,740,186 and the prior art cited therein.

Rain can style showerheads (e.g., shown in FIG. 1A) have become increasingly popular because they provide the user with a rain-shower like pattern of spray, drenching the user's entire body with just enough pressure to make it mildly invigorating. The desired sensation for user has been described as a "natural rainfall experience" where the shower head creates a gentle, drenching rainfall-like full-body spray coverage from an array of nozzles or fluid jets originating from relatively a large showerhead front surface area.

Rain can shower heads are traditionally mounted upon a long (e.g., 13-inch) gooseneck shower arm to provide an above-the-head position, but can also be configured for use on a traditional showerhead supporting pipe nipple projecting from an elevated position on a wall. A rain-can shower head is typically larger than an ordinary shower head and may have a six-inch-diameter face with forty (40) or more spray channels, in an effort to provide the full-body drenching spray which simulates rainfall. The effect desired can be characterized as a relatively uniform spray originating from a larger surface area than is provided by a typical showerhead.

Getting a uniform pattern of spray is not easy, though. Stationary spray heads with fixed jets are the simplest of all spray heads, consisting essentially of a water chamber or manifold and one or more jets directed to produce a constant pattern. Stationary spray heads with adjustable jets are typically of a similar construction, except that it is possible to make some adjustment of the jet opening size and/or the number of jets utilized. However, these types of jets provide a straight often piercing directed flow of water. These stationary spray heads cause water to flow through apertures and continuously contact essentially the same points on a user's body. Therefore, the user feels a stream of water continuously on the same area and, particularly at high pressures or flow rates, the user may sense that the water is drilling into the body. Rain can spray heads represent an effort to reduce this undesirable feeling, by enlarging the area emitting the sprays, but each jet of water, when emitted from a static nozzle, still drills into one spot. This is why makers of rain can style showerheads wish they could provide better nozzles in their products.

Generally speaking, fluidic oscillators are known in the prior art for providing a wide range of liquid spray patterns by cyclically deflecting a liquid jet. Examples of fluidic oscillators may be found in many patents, including U.S. Pat. No. 3,185,166 (Horton & Bowles), U.S. Pat. No. 3,563,462 (Bauer), U.S. Pat. No. 4,052,002 (Stouffer & Bray), U.S. Pat. No. 4,151,955 (Stouffer), U.S. Pat. No. 4,157,161 (Bauer), U.S. Pat. No. 4,231,519 (Stouffer), which was reissued as RE 33,158, U.S. Pat. No. 4,508,267 (Stouffer), U.S. Pat. No. 5,035,361 (Stouffer), U.S. Pat. No. 5,213,269 (Srinath), U.S. Pat. No. 5,971,301 (Stouffer), U.S. Pat. No. 6,186,409 (Srinath) and U.S. Pat. No. 6,253,782 (Raghu), which are summarized below.

The operation of fluidic oscillators is usually characterized by the cyclic deflection of a fluid jet without the use of mechanical moving parts. Consequently, an advantage of fluidic oscillators is that they are not subject to the wear and tear which adversely affects the reliability and operation of pneumatic oscillators and reciprocating nozzles. The fluidic oscillators described in U.S. Pat. No. 3,185,166 (Horton & Bowles) are characterized by the use of boundary layer attachment (i.e., the "Coanda effect," so named for Henri Coanda, the first to explain the tendency for a jet issuing from an orifice to deflect from its normal path (so as to attach to a nearby sidewall) and the use of downstream feedback passages which serve to cause the jet issuing from a power nozzle to oscillate between right and left side exit ports.

At the risk of boring those having skill in this rather specialized art, a substantive background will be provided here. It is understood that the three-dimensional character of the flow from such fluidics can take a variety of forms depending upon the three-dimensional shape of the fluidic. For example, oscillators described in U.S. Pat. No. 4,052,002 (Stouffer & Bray) are characterized by the selection of the dimensions of the fluidic such that no ambient fluid or primary jet fluid is ingested back into the fluidic's interaction region, which yields a relatively uniform spray pattern made up of droplets of more uniform size. The absence of inflow or ingestion from outlet region is achieved by creating a static pressure at the upstream end of interaction region which is higher than the static pressure in outlet region. This pressure difference is created by a combination of factors, including: (a) the width T of the exhaust throat is only slightly wider than power nozzle so that the egressing power jet fully seals the interaction region from outlet region; and (b) the length D of the interaction region from the power nozzle to throat, which length is significantly shorter than in prior 'fluid ingesting' oscillators. It should be noted that the width X of control passages is smaller than the power nozzle. If the width of power nozzle at its narrowest point is W, then the following relationships were found to be suitable, although not necessarily exclusive, for operation in the manner described: T=1.1–2.5 W and D=4–9 W, with the ratios of these dimensions also being found to control the fan angle over which the fluid is sprayed. By adding a divider in this fluidic's outlet region, it becomes what can be referred to as two-outlet oscillator of the type that might be used in a windshield washer system. See, for example, U.S. Pat. No. 4,157,161 to Bauer.

The fluidic oscillators described in U.S. Pat. No. 4,231,519 (Stouffer, reissued as U.S. Pat. No. RE 33,158), are also unique in that they employ yet another fluid flow phenomena to yield an oscillating fluid output. The oscillators of U.S. Pat. No. 4,231,519 are characterized by their utilization of the phenomena of vortex generation, within an expansion chamber prior to the fluidic's throat, as a means for dispersing fluid. It comprises a jet inlet that empties into an expansion chamber which has an outlet throat at its downstream end. It also has an interconnection passage that allows fluid to flow from one side to the other of the areas surrounding the jet's inlet into its expansion chamber. The general nature of the flow in such fluidics is that vortices are seen to be formed near the throat. As the vortices grow in size they cause the centerline of the fluid flowing through the expansion chamber to be deflected to one side or the other such that the fan angle of the jet issuing from the throat ranges from approximately +45 degrees to −45 degrees. The result of these flow oscillations is a complicated spray pattern, which at a given instant takes a sinusoidal form (similar to that shown in FIG. 6(*e*) in commonly owned U.S. Pat. No. 6,805,164).

The fluidic oscillators disclosed in U.S. Pat. No. 5,213,269 (Srinath) and U.S. Pat. No. 5,971,301 (Stouffer) are referred to as "box oscillators" having interconnects which serve to help control the oscillating dynamics of the flow that exits from the fluidic's throat. For example, the effect of these interconnects, assuming that they are appropriately dimensioned relative to the other geometry of the fluidic, is generally seen to be about a doubling of the fan angle of the fluid exiting from the fluidic's throat. FIG. 8(*a*) from U.S. Pat. No. 5,213,269 shows an embodiment in which the interconnect takes the form of passage that connects points on opposite side of the fluid's throat. FIG. 8(*b*) from U.S. Pat. No. 5,971,301 shows an embodiment in which the interconnect takes the form of a slot in the bottom wall of the fluidic's interaction region.

U.S. Pat. No. 6,253,782 (Raghu) discloses a fluidic oscillator of the type that provides a shaped interaction region having two entering power nozzles and a single throat through which the resulting fluid flow exits the fluidic oscillator. See FIGS. 9(*a*)-(*b*). The jets from the power nozzles are situated so that they interact to form various vortices which continually change their positions and strengths so as to produce a sweeping action of the fluid jet that exits the throat of the fluidic. In a preferred embodiment, the interaction region has a mushroom or dome-shaped outer wall in which are situated the power nozzles.

U.S. Pat. No. 6,186,409 (Srinath) discloses a fluidic oscillator which has two power jets entering a fluid interaction region from the opposite sides of its longitudinal centerline. The jets are fed from the same fluid source, and are unique because they employ a filter between the jet source and the upstream power nozzles to remove any possible contaminants in the fluid.

The instant applicant has patented shower head and personal spray devices with oscillating fluid jets, but has never applied fluidic technology to a rain can style showerhead. As noted above, this application is commonly owned with U.S. Pat. Nos. 4,122,845 and 7,111,800, the entire disclosures of which are also incorporated herein by reference. Fluidic oscillators, as described in these patents and other patent applications to this applicant, have no internal moving parts, and yet are capable of generating an oscillating spray of droplets which are much more like rainfall than the standard showerhead's water-drilling static jets.

Unfortunately, it is not a trivial matter to replace nozzles generating static jets with fluidic oscillators. In many liquid spray applications, like the rain can showerhead assembly, a plurality of nozzles fed via a bowl-shaped showerhead water chamber or manifold have a central flow inlet which may be configured with a pivoting ball joint so that the shower head assembly can be aimed. In such cases, because of the nature of the inlet, the flow inside the manifold becomes very turbulent. Fluidic inserts are sensitive to turbulence and a traditional nozzle assembly or shower head incorporating a traditional fluidic circuit will not spray or fan as intended, because turbulent inlet or manifold flow disrupts the operation of traditional fluidic oscillators.

There is a need, therefore, for a reliable, inexpensive and unobtrusive system and method for improving the operational characteristics of devices including fluid manifolds or other fluid conveying structures that are prone to generating turbulent inlet flow.

SUMMARY OF THE INVENTION

Accordingly, it is an object of the present invention to overcome the above mentioned difficulties by providing a reliable, inexpensive and unobtrusive system and method for improving the operational characteristics of devices including fluid manifolds or other fluid conveying structures that are prone to generating turbulent inlet flow. A fluidic oscillator adapted for use in a showerhead or nozzle assembly includes an eddy filter structure which reduces the adverse effects of fluid supply turbulence on the fluidic oscillator's spraying performance.

A nozzle assembly or rain can style showerhead assembly includes a water chamber or manifold which carries and is configured to receive a fluid via a central flow inlet fitting. Fluid entering the interior of the water chamber or manifold flows turbulently into and through the manifold and is expelled under pressure through a plurality of nozzles which are preferably configured as specially adapted fluidic circuits or fluidic inserts, in accordance with the present invention.

After studying the problem, the applicants have discovered that this turbulence comprise eddies of various length scales. Fluidic circuits, generally, and more specifically fluidic inserts are sensitive to inlet or fluid source turbulence, especially when the length scale of the turbulence is comparable to critical fluidic geometry dimensions like the fluidic insert's power nozzle width or depth. In such conditions, a nozzle assembly or shower head incorporating a fluidic circuit will not spray or fan as intended. Fluidic inserts are preferred in the rain can (showerhead) application as compared to drilling streams or "needle" jets that most rain cans provide, and, in one embodiment of the present invention, a plurality of fluidics are arrayed over a large area, where each fluidic insert generates a spray pattern having about an 18 deg fan angle and a massaging feel. This spray pattern makes the fluidic rain can showerhead experience more relaxing when compared to those with static drilling streams, but turbulent manifold inlet flow disrupts the operation of nozzle assemblies or shower heads with the fluidic oscillators.

One purpose of the present invention is to enable the fluidic circuits to work properly and reliably under conditions of high turbulence in the inlet flow. As mentioned above, there are applications where the turbulence levels in the incoming flow cannot be reduced to levels at which traditional fluidic circuits can operate properly. This turbulence consists of eddies of various length scales. In a fluidic circuit, there is power nozzle geometry and throat geometry. When the incoming flow has turbulent eddies of the same length scale as the power nozzle dimension, the performance of the fluidic is adversely affected.

In order to make the fluidic inserts in the rain can showerhead assembly perform more effectively and reliably when incoming water is providing a widely varying turbulent flow into the pressurized manifold, the applicants sought a mechanism, method or structure which would make the fluidic nozzles more tolerant of widely varying turbulent inflow steams from the manifold, so that the nozzles, when arrayed over a large surface area, reliably generate an effective and measured spray which is ideally well suited for making a uniform rain-like pattern of sprays.

An exemplary embodiment of the structure of the present invention includes a fluidic circuit having an inlet with "eddy filter", which comprises an array of at least a first aligned row of evenly spaced filter posts, and preferably a second parallel aligned row of aligned filter posts is spaced behind the first row and offset, so that a space between adjacent filter posts in the first row is centered on the central axis of a filter post in the second row. The spacing between the filter posts in the first row of posts (i.e., the inter-post gap a) is preferably about 1 mm. The spacing between the first (or upstream) row of posts and the second (or downstream) row of posts (or the inter-row spacing b) is also preferably about 1 mm.

There are a few designs of fluidic circuits that are suitable for use with the fluidic oscillators and shower head assembly of the present invention. Many of these have some common features, including: an inlet for flow to enter the circuit, at least one power nozzle configured to accelerate the movement of the liquid that flows under pressure through the oscillator, an interaction chamber through which the liquid flows and in which the fluid flow's deflection inducing phenomena is initiated that will eventually lead to the flow from the fluidic being of an oscillating nature, and an outlet from which the liquid sprays. In the exemplary embodiment, an island oscillator is selected for adaptation with an eddy filter in the inlet. Generally speaking, the island oscillator is described in the commonly owned U.S. Pat. No. 4,151,955, the entire disclosure of which is incorporated by reference.

In an exemplary embodiment of a fluidic used in the present invention, the turbulent incoming fluid from the manifold is passed through the eddy filter and the adverse effect of the incoming fluid is diminished. The fluid then passes into the interior volume of the fluidic where an island obstacle creates two rows of vortices in the wake of the obstacle, the vortices being formed in periodic alternation on different sides of the island obstacle's center line. This vortex pattern causes perturbations which deflect the fluidic's spray in a cycle. The strength of the vortices is dependent upon a number of factors, including: Reynolds number of the stream (the higher the Reynolds number the greater the strength); and the shape of obstacle 114. Applicants have discovered that the eddy filter structure enables a fluidic circuit using the vortex street phenomenon to reliably effect a time varying deflection in the sprayed droplets, even when the fluid is supplied from a source or manifold with significant turbulence in the inlet flow. The fluidic circuit or oscillator can be made from a solid block of plastic, metal, or the like, and has channels or recesses formed in its top surface. The top surface recesses are sealed by a cover plate or are inserted into a fluid-tight through bore defining substantially planar, sealing walls in the shower head assembly's front surface. The fluidic's recessed areas include a chamber having an inlet passage and outlet. The island is positioned downstream of eddy filter in the path of the incoming fluid stream which passes through the chamber between the inlet and the outlet.

The fluidic's outlet is defined between two aligned opposing edges which form a restriction proximate the downstream facing sides of the island. This restriction is sufficiently narrow to prevent ambient fluid from entering the chamber where the vortices are formed. In other words, the throat or restriction between the edges forces the liquid outflow to fill the outlet therebetween and precludes entry of ambient air. The vortex street formed by island obstacle causes the stream, upon issuing from the fluidic's outlet, to cyclically sweep back and forth transversely of the flow direction. The issued swept stream or spray is swept back and forth in a plane. If the fluid is liquid, the sweeping action causes an issued jet to first break up into ligaments and then, due to viscous interaction with air, into droplets which are distributed in a fan-shaped pattern in the plane of the sweeping action.

Returning to the problem of manifold turbulence, large turbulent eddies in the water flowing into the fluidic's inlet are damped, filtered or reduced to smaller eddies as they pass through the filter post array.

Due to the staggered nature of the posts, the resulting eddies will be even smaller than either the smaller of the inter-post gap a or the inter-row spacing b. Note that a and b can be equal. The staggered filter posts thus allow filtration and alteration of eddies in the passing fluid, where the fluid eddies are changed to a length scale smaller than the filter dimension. This enables larger filter dimensions, which is an advantage that provides increased fluid flow rate and reduced problems with clogging. However, one can also use a single row of filter posts.

Dimensions a or b are selected so they are smaller than the power nozzle dimensions. For example, in the illustrated embodiment, filter openings (a and b)=1.00 mm, and for a selected filter post diameter=0.70 mm, this eddy filter geometry works well for a power nozzle width of 2.40 mm. This configuration ensures that filtered turbulent eddies are much smaller than the power nozzle width dimension. Under such conditions the fluidic nozzle performs reliably and correctly with the desired spray fan angle.

The above and still further objects, features and advantages of the present invention will become apparent upon consideration of the description of a specific embodiment thereof, particularly when taken in conjunction with the accompanying drawings.

DESCRIPTION OF THE FIGURES

FIG. 5 is a schematic plan view illustrating an alternate fluidic insert incorporating an eddy filter array, in accordance with the present invention.

FIG. 6 is a perspective view of the interior surface of the nozzle or showerhead assembly; the illustrated rain can assembly has twelve (12) inserts, each including the eddy filter; water flows into the manifold or rain can assembly at the center of the rain can and then is fed to the different fluidic inserts that are located at different radial positions, in accordance with the present invention.

DESCRIPTION OF THE PREFERRED EMBODIMENT

Figure 1A:
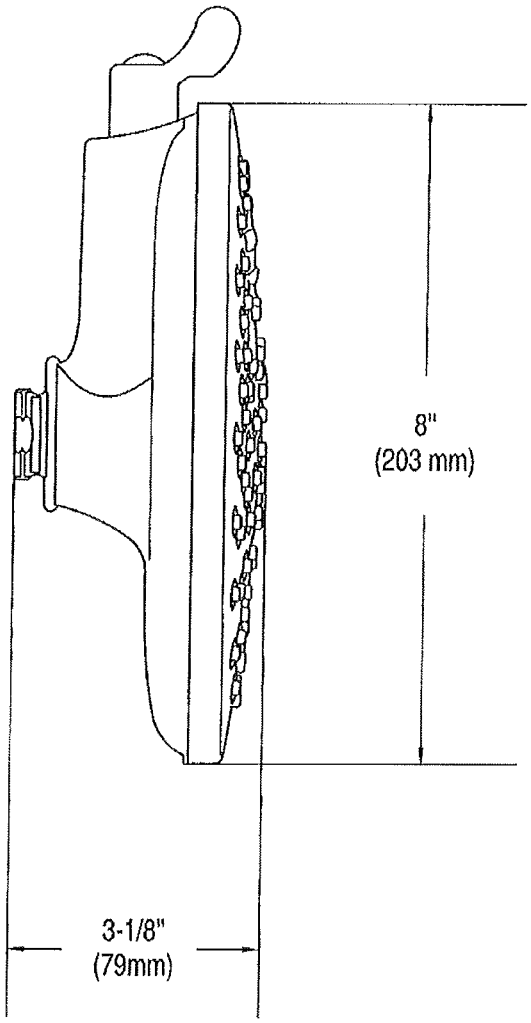
FIG. 1A PRIOR ART
FIG. 1A is a perspective view of a traditional rain can style shower head, in accordance with the prior art.
Figure 1B:
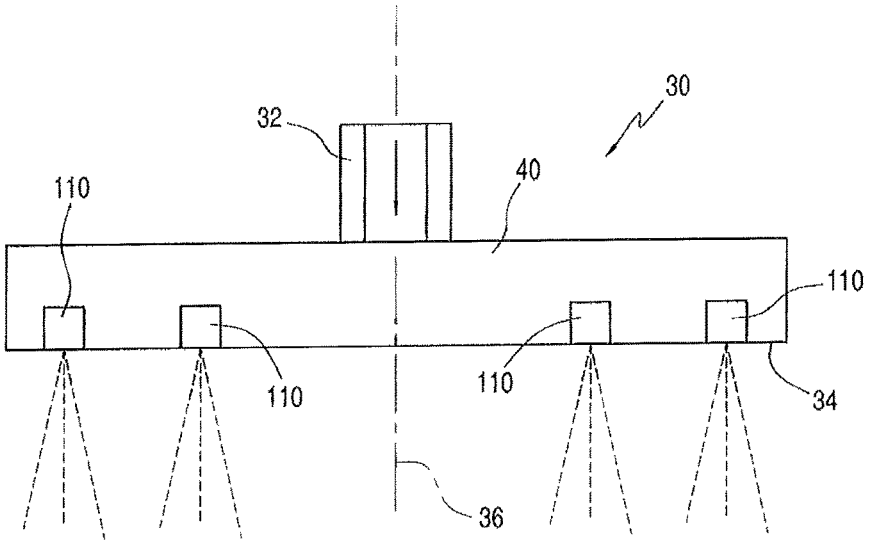
FIG. 1B is a schematic diagram illustrating a cross sectional view of a nozzle assembly or shower head having a central fluid flow inlet which provides turbulent water flow into a manifold supplying a bank of fluidic inserts, in accordance with the present invention.

Turning now to FIGS. 1B-8, in accordance with the present invention,

A nozzle assembly or rain can style showerhead assembly 30 includes a water chamber or manifold 40 which carries and is configured to receive a fluid via a central flow inlet fitting 32. Fluid entering the interior of the water chamber or manifold 40 flows turbulently into and through the manifold and is expelled under pressure through a plurality of nozzles which are preferably configured as specially adapted fluidic circuits or fluidic inserts 110. FIG. 1A is a schematic diagram illustrating a cross sectional view of nozzle or shower head assembly 30 with its central fluid flow inlet providing turbulent water flow into manifold 40 which supplies a bank comprising a plurality (e.g., twelve) fluidic inserts, in accordance with the present invention. Fluid inlet fitting 32 is preferably made of a metal such as brass, or plastic or the like, and is adapted to threadably engage a fitting such as a standard ½ inch pipe fitting and preferably includes wrench flats on an exterior sidewall surface for ease of installation and removal. Shower head assembly 30 preferably has a relatively large circular frontal spray area or face 34, with a diameter of 4 to 8 inches, in the rain can style, and the fluidic insert nozzles are preferably arrayed upon that circular front face at different radial distances from the central axis 36 of the nozzle assembly so that the resultant spray from shower head assembly provides a widely distributed and uniform distribution of water droplets.

Figure 7:
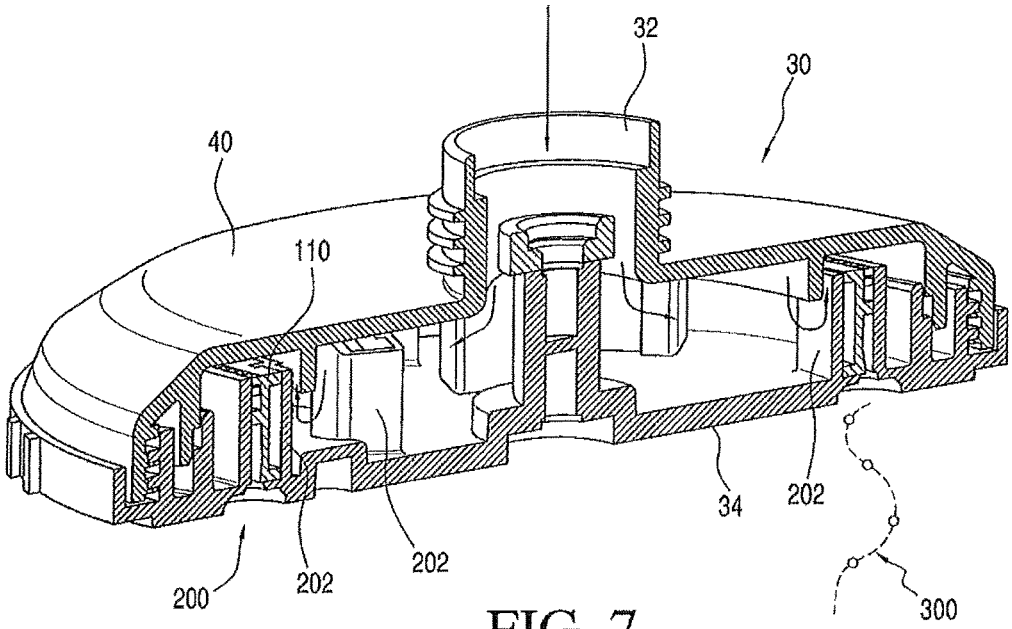
FIG. 7 is a perspective cross section view, in elevation, showing the inlet flow and the turbulent flow leading to the fluidic inserts, each including the eddy filter; water flows into the manifold or rain can assembly at the center and then is fed to the fluidic inserts at their different radial positions, in accordance with the present invention.
Figure 8:
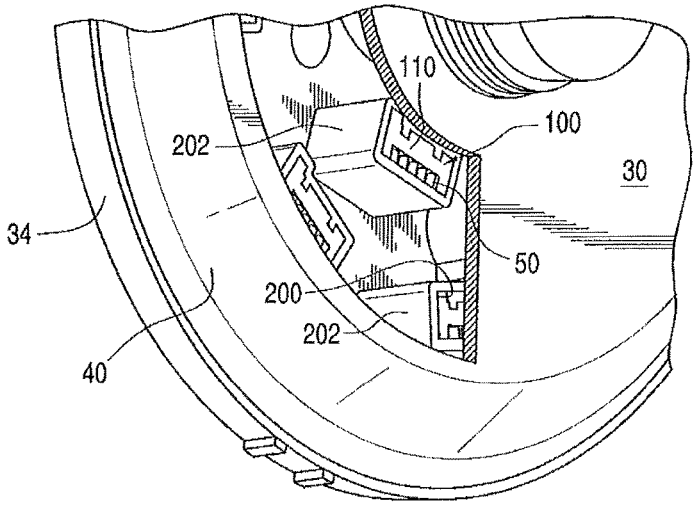
FIG. 8 is a perspective and partially cut-away view, showing the position and orientation of the fluidic inserts and the eddy filter posts at the fluidics' inlets, in accordance with the present invention.

The front face portion 34 of rain can assembly 30 is optionally removably attachable to the manifold 40 or back portion and is also made from a metal such as brass, or plastic or the like. Additional details of an exemplary embodiment of rain can assembly 30 are illustrated in FIGS. 6, 7 and 8, and described below.

Referring specifically to FIGS. 1B-3 the turbulent incoming fluid from the manifold 40 is, within each fluidic insert 110, passed through an eddy filter 100 comprising an array of circular section posts 50, 60, and the adverse effect of the incoming fluid's turbulence is diminished by the effect of eddy filter 100 on the passing flow, as will be described in greater detail below.

Figure 2:
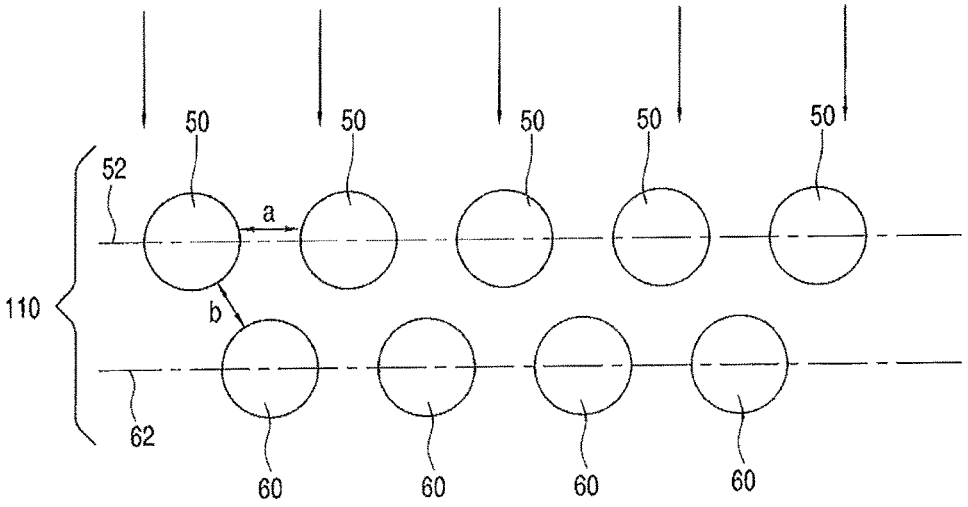
FIG. 2 is a schematic plan view illustrating an eddy filter layout having first and second rows of filter posts in a staggered array to enhance the fluid flowing into a fluidic, in accordance with the present invention.
Figure 3:
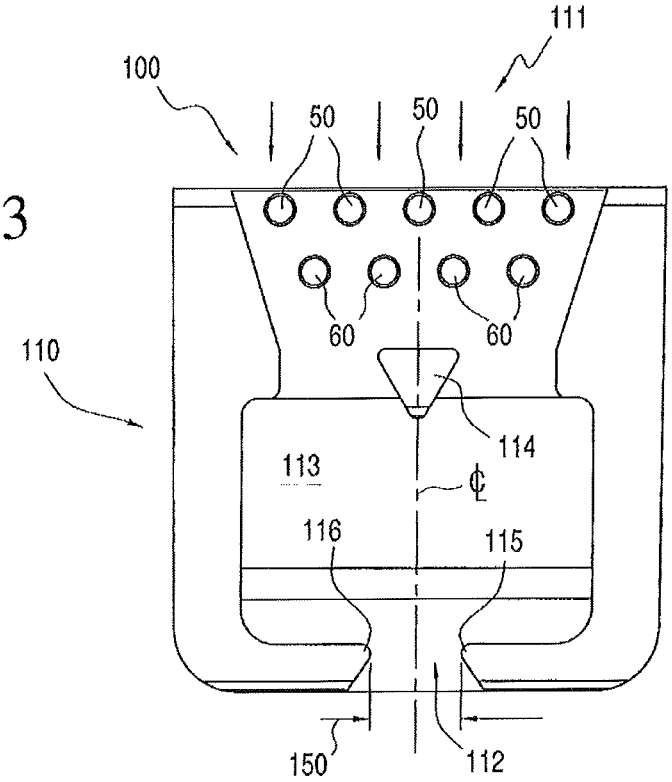
FIG. 3 is a schematic plan view illustrating a fluidic insert incorporating the eddy filter array of FIG. 2, in accordance with the present invention.

Referring now to FIGS. 2 and 3, an exemplary embodiment of the structure of the present invention includes a fluidic circuit having an inlet with "eddy filter" 100, which comprises an array of at least a first row of evenly spaced upwardly projecting cylindrical filter posts 50 aligned along a linear first axis 52, and preferably a second, parallel row of filter posts 60 aligned along a second axis 62 which is spaced behind the first row and offset, so that a space between adjacent filter posts 50 in the first row is centered on the central axis of a filter post 60 in the second row. The spacing between the filter posts in the first row of posts (i.e., the inter-post gap a) is preferably about 1 mm. The spacing between the first (or upstream) row of posts and the second (or downstream) row of posts (or the inter-row spacing b) is also preferably about 1 mm.

As best seen in FIGS. 2 and 3, the fluid passes into the interior volume of an exemplary fluidic 110 where an island obstacle 114 creates two rows of vortices in the wake of the obstacle 114, the vortices being formed in periodic alternation on different sides of the island obstacle's center line CL. This vortex pattern is called a Karman vortex street or, more familiarly, a vortex street. Vortex streets, their formation and effect, have been studied in great detail in relation to fluid-dynamic drag, particularly as applied to air and water craft. Essentially, when the flow impinges upon the blunt upstream-facing surface of obstacle 114, due to some random perturbation slightly more flow will pass to one side (e.g., the left side in FIG. 3) than the other. The increased flow past the left side creates a vortex just downstream of the upstream-facing surface. The vortex tends to back-load flow around the left side so that more flow tends to pass around the right side, thereby reducing the strength of the left side vortex but initiating a right side vortex. When the right side vortex is of sufficient size it back-loads flow about that side to redirect most of the flow past the left side to restart the cycle. The strength of the vortices is dependent upon a number of factors, including: Reynolds number of the stream (the higher the Reynolds number the greater the strength); and the shape of obstacle 114. Applicants have discovered that the eddy filter structure 100 enables a fluidic circuit using the vortex street phenomenon to reliably effect a time varying deflection in the sprayed droplets, even when the fluid is supplied from a source or manifold (e.g., 40) with significant turbulence in the inlet flow.

For ease in reference, operation of this and ensuing embodiments is described in terms of water sprayed into an ambient air environment; however, it is to be understood that the present invention works equally well when another liquid is sprayed into another liquid or gas.

Referring to FIG. 3 specifically, fluidic circuit or oscillator 110 is shown in the form of a solid block of plastic, metal, or the like, having recesses formed in its top surface. The top surface recesses are optionally sealed by a cover plate or preferably are inserted into a fluid-tight through bore 200 defined by substantially four planar, inwardly projecting sealing walls 202 (shown in FIGS. 6-8 for purposes of clarity). The fluidic's recessed areas include a chamber 113 having an inlet passage 111 and outlet 112. Island 114 is positioned downstream of eddy filter 100 and projects upwardly (in the plan view of FIG. 3) into the path of a fluid stream passing through the chamber 113 between inlet 111 and outlet 112. Island 114 is shown as a triangle, in plan view, with one side facing upstream (i.e. toward inlet 111) and the other two sides facing generally downstream and converging to a point on the longitudinal center CL of the oscillator. Neither the shape, orientation, or symmetry of the island is limiting on the present invention. However, a blunt upstream-facing surface has been found to provide a greater vortex street effect than sharp, aerodynamically smooth configuration, while the orientation and symmetry of the island or obstacle has an effect (to be described) on the resulting flow pattern issued from the device.

The exemplary fluidic's outlet 112 is defined between two edges 115 and 116 which form a restriction proximate the downstream facing sides of island 114. This restriction is sufficiently narrow to prevent ambient fluid from entering the region adjacent the downstream-facing sides of island 114, the region where the vortices of the vortex street are formed. In other words, the throat, power nozzle or restriction between edges 115, 116 forces the liquid outflow to fill the region 112 therebetween and preclude entry of ambient air. The vortex street formed by obstacle 114 causes the stream, upon issuing from body 110, to cyclically sweep back and forth transversely of the flow direction. Outlet 112 is also referred to as the "power nozzle" and the distance between the restricting opposing projections 115, 116 is referred to as the "power nozzle width" 150, which, in the illustrated embodiment, is approximately 2.4 mm.

A cavitation region tends to form immediately downstream of the island 114. Depending upon the size of this cavitation region and where it is positioned relative to the outlet 112 of the device, the device will produce a swept jet, swept sheet, or a straight unswept jet. More particularly, the two portions of the stream, which flow around opposite sides of the island 114, recombine at the downstream terminus of the cavitation region. If this terminus is sufficiently upstream from the outlet (as in the embodiment illustrated in FIG. 3), the two stream portions recombine well within the device, the shed vortices are well-defined, and the resulting jet is cyclically swept by the shed vortices, still within the device. The swept jet then issues in its swept jet form. If, however, the downstream terminus of the cavitation region is close to the outlet, the shed vortices are less well-defined and tend to interlace with one another. This forces the two stream portions to be squeezed into impingement proximate the outlet 112, the stream portions forming a thin sheet in the plane normal to the plane of the device. The vortices oscillate the sheet back and forth. When the terminus of the cavitation region is outside the device, no vortices are shed and the two stream portions eventually come together beyond the confines of the device. The resulting jet is not oscillated due to the absence of the vortices. Whether a swept jet or a swept sheet, the issued swept stream is swept back and forth parallel to the plane of the drawing. If the fluid is liquid, the sweeping action causes an issued jet to first break up into ligaments and then, due to viscous interaction with air, into droplets which are distributed in a fan-shaped pattern in the plane of the sweeping action. The liquid sheet, because of the sheet-forming phenomenon, breaks up into finer droplets which are similarly swept back and forth.

As water flows into and through manifold 40, large turbulent eddies are filtered or reduced to smaller eddies when passing through the filter post array 100. Due to the staggered nature of the posts, the resulting eddies will be even smaller than either the smaller of the inter-post gap a or the inter-row spacing b. Note that a and b can be equal, and in the illustrated embodiment, each are approximately 1 mm. The staggered filter posts 50, 60 thus allow filtration and alteration of eddies in the passing fluid, where the fluid eddies are changed to a length scale smaller than the filter dimension (a or b, or smaller than 1 mm). This enables larger filter dimensions, which is an advantage that provides increased fluid flow rate and reduced problems with clogging. However, one can also use a single row of filter posts (e.g., 50, aligned along linear axis 52).

Dimensions a or b are selected so they are smaller than the power nozzle dimensions. For example, in the illustrated embodiment, filter openings (a and b) equal 1.00 mm, and for a selected filter post diameter (the first array posts 50 and the second array posts 60 each have a diameter of 0.70 mm), this eddy filter geometry works well for a power nozzle width 150 of 2.40 mm (e.g., as shown in FIG. 3). So the filter openings defined by the inter post and inter row spacings (a and b, both about 1 mm) are selected to be less than half the power nozzle's width (at 2.4 mm). This configuration ensures that filtered turbulent eddies are much smaller than the power nozzle width dimension. Under such conditions the fluidic nozzle 110 performs reliably and correctly with the desired spray fan angle (e.g., 18 degrees).

Figure 4:
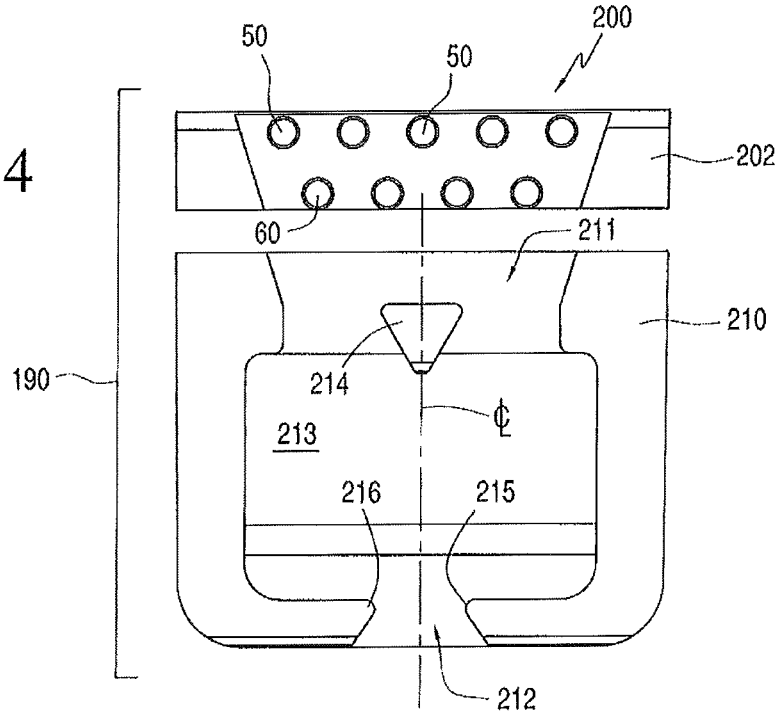
FIG. 4 is a schematic plan view illustrating a two-part fluidic insert assembly incorporating a separate eddy filter array component which is configured for use upstream of a separate fluidic oscillator, having an eddy filter outlet which is dimensioned and aligned the fluidic's inlet and having lateral sidewalls angled to match the angled sidewalls of the fluidic's inlet, in accordance with the present invention.

In an alternative embodiment, an assembly 190 has an the eddy filter 200 configured with a first array of first posts 50 upstream of a second array of second posts 60, where eddy filter 200 is a separate component dimensioned for use with a fluidic insert 210. FIG. 4 is a schematic plan view illustrating a two-part fluidic insert assembly 190 incorporating separate eddy filter array component 202 which is configured for use upstream of a separate fluidic oscillator 210, having an eddy filter inlet which receives fluid from plenum 40 and an eddy filter outlet which is dimensioned and aligned the fluidic's inlet 211 and having lateral sidewalls angled to match the angled sidewalls of the fluidic's inlet 211, in accordance with the present invention. Referring to FIG. 4 specifically, fluidic circuit or oscillator 210 is shown in the form of a solid block of plastic, metal, or the like, having recesses formed in its top surface. The top surface recesses are optionally sealed by a cover plate or preferably are inserted into a fluid-tight through bore 200 defined by substantially four planar, inwardly projecting sealing walls 202 (shown in FIGS. 6-8 for purposes of clarity). The fluidic's recessed areas include a chamber 213 having an inlet passage 211 and outlet 212. Island 214 is positioned downstream of eddy filter 200 in the path of a fluid stream passing through the chamber 213 between inlet 211 and outlet 212. Island 214 is shown as a triangle, in plan view, with one side facing upstream (i.e. toward inlet 211) and the other two sides facing generally downstream and converging to a point on the longitudinal center CL of the oscillator. Outlet 212 is also referred to as the "power nozzle" and the distance between the restricting opposing projections 215, 216 is referred to as the "power nozzle width", which, in the illustrated embodiment, is approximately 2.4 mm. Here again, the inter post and inter row spacings (a and b, both about 1 mm) are selected to be less than half the power nozzle's width (at 2.4 mm).

When using the embodiment of FIG. 4, the fluidic insert 210 and the eddy filter insert 202 are tightly approximated so fluid can only flow along the CL central axis and through chamber 213. As water flows into and through showerhead manifold 40, large turbulent eddies are filtered or reduced to smaller eddies when passing through the filter post array 200. Due to the staggered nature of the posts, the resulting eddies will be even smaller than either the smaller of the inter-post gap a or the inter-row spacing b. Note that a and b can be equal, and in the illustrated embodiment, each are approximately 1 mm. The staggered filter posts 50, 60 thus allow filtration and alteration of eddies in the passing fluid, where the fluid eddies are changed to a length scale smaller than the filter dimension (a or b, or smaller than 1 mm). This enables larger filter dimensions, which is an advantage that provides increased fluid flow rate and reduced problems with clogging. However, one can also use a single row of filter posts (e.g., 50, aligned along linear axis 52).

As above, eddy filter dimensions a and b are selected so they are smaller than the power nozzle dimensions. For example, in the illustrated embodiment of FIG. 4, filter openings (a and b) equal 1.00 mm, and for a selected filter post diameter (the first array posts 50 and the second array posts 60 each have a diameter of 0.70 mm), this eddy filter geometry works well for a power nozzle width of 2.40 mm (e.g., as shown in FIG. 4). This configuration ensures that filtered turbulent eddies are much smaller than the power nozzle width dimension. Under such conditions the fluidic nozzle assembly 190 performs reliably and correctly with the desired spray fan angle.

There are many different and well known designs of fluidic circuits that are suitable for use with the fluidic oscillators of the present invention. For example, an eddy filter post array 300 can be incorporated into a three-jet island oscillator 310 as illustrated in FIG. 5. Many of these have some common features, including: an inlet or entrance 311 for fluid flow to enter the circuit's interior, at least one power nozzle configured to accelerate the movement of the liquid that flows under pressure through the oscillator, an interaction chamber 313 through which the liquid flows and in which the fluid flow phenomena is initiated that will eventually lead to the flow from the oscillator being of an oscillating nature, and an outlet 312 from which the liquid exits the oscillator 310.

For all of the foregoing embodiments, large turbulent eddies are filtered or reduced to smaller eddies as they pass through the filter post array. In the illustrated embodiments, staggered filter posts 50, 60 thus allow filtration and alteration of eddies in the passing fluid, where the fluid eddies are changed to a length scale smaller than the filter dimension (e.g., 1 mm). This enables larger filter dimensions, which is an advantage that provides increased fluid flow rate and reduced problems with clogging from hard water or the like, which would otherwise result in calcium and magnesium deposits clogging the fluidic inserts, changing the flow and compromising the oscillating action of the fluidic.

Turning now to a description of a finished prototype, FIG. 6 is a perspective view of the interior surface of the nozzle or showerhead assembly 30. The illustrated rain can assembly 30 carries twelve (12) fluidic circuit inserts 110, each including the eddy filter 100. As illustrated, water flows into the manifold 40 or rain can assembly at the center of the rain can and then is fed to the different fluidic inserts 110 that are located at different radial positions, in accordance with the present invention. FIG. 7 shows the tortuous path for the water as it flows from inlet 32 to the fluidic inserts, each including an eddy filter 110. FIG. 8 is a perspective and partially cut-away view, showing the position and orientation of the inwardly projecting sealing walls 202 which define the through bores 200 dimensioned to receive and retain the fluidic inserts 110 with the eddy filter array's posts at the fluidics' inlets, in accordance with the present invention.

As can be seen from FIG. 6, the fluidic nozzle assemblies are arrayed in first and second radial arrays. In the first radial array, a set of four equally spaced fluidics are arranged at 90 degree intervals and aligned so that the long axis of each fluidic's power nozzle or outlet is substantially tangent to an imaginary inner circle. The first radial array has a circle diameter of a few inches. The second radial array is aligned along a larger imaginary circle than the first array, and comprises a set of eight equally spaced fluidics are arranged at 45 degree intervals and aligned so that the long axis of each fluidic's power nozzle or outlet is substantially tangent to a second, larger imaginary outer circle and so each fluid in the second array is closer to the shower head assembly's outer peripheral edge than the fluidics in the first, inner array.

The water sprayed from each of the twelve fluidic inserts will reliably oscillate in time varying patterns of deflected droplets 300 which are sprayed distally or frontwardly, beyond the front face 34 of the shower to provide the desired gentle, drenching rainfall-like full-body spray coverage. As shown in FIG. 6, each oscillating spray 300 originates from a different portion of the front surface 34.

Like traditional rain can shower heads, nozzle assembly 30 is readily adapted for mounting on a long (e.g., 13-inch) gooseneck shower arm to provide an above-the-head position, but can also be configured for use on a traditional showerhead supporting pipe nipple projecting from an elevated position on a wall.

While the embodiments illustrated work well, they are not intended to be limiting. For example, in the illustrated embodiments of FIGS. 2 and 3, the fluidic circuit has an inlet with "eddy filter" 110 comprises an array of at least a first row of evenly spaced filter posts 50 aligned along a straight first axis 52, and preferably a second, parallel row of filter posts 60 aligned along a straight second axis 62 which is spaced behind the first row and offset, so that a space between adjacent filter posts 50 in the first row is centered on the central axis of a filter post 60 in the second row. While the exemplary embodiment places the first filter post axis 52 and the second filter post axis 62 in alignments that are transverse to the inlet centerline and transverse to the direction of incoming water flow, those straight lines are not mandatory. For example, the applicants could readily configure an eddy filter with first and second rows of spaced filter posts aligned along spaced curved lines, where an array of at least a first row of evenly spaced filter posts 50 aligned along an arcuate first axis 52' (not shown), and preferably a second, parallel row of filter posts 60 aligned along an arcuate second axis 62 which is spaced behind the first row and offset, so that a space between adjacent filter posts 50 in the first row is centered on the central axis of a filter post 60 in the second row. The spacing between the filter posts in the first row of posts (i.e., the inter-post gap a) would remain about 1 mm. The spacing between the first (or upstream) row of posts and the second (or downstream) row of posts (or the inter-row spacing b) would also preferably about 1 mm, and the first filter post arc 52' and the second filter post arc 62' would remain in alignments that cross the inlet centerline and so cross the direction of incoming water flow. It will be also appreciated by those of skill in the art that the method and apparatus of the present invention provides an improved nozzle assembly, especially when fluid supplies are turbulent. Generally speaking, showerhead or nozzle assembly 30 includes:

(a) a manifold 40 or chamber configured to receive pressurized fluid, said manifold including an open interior volume which is pressurized with inward flowing fluid, said manifold being bounded by a perforated front face 34 defining a plurality of channels or throughbores 200 configured to permit fluid to flow distally or forwardly therethrough;

(b) a plurality of fluid oscillator devices (e.g., 110) each being configured to be received within or in fluid communication with said front manifold's face channels 200, wherein each fluid oscillator has a body member with a chamber (e.g., 113) therein, said chamber having a fluid inlet (e.g., 111) for receiving manifold fluid under pressure from said manifold and admitting said fluid into said chamber and a fluid outlet (e.g., 112) for issuing pressurized fluid from said chamber forwardly and into an ambient environment, said inlet and outlet defining a flow path therebetween for flow of fluid through said chamber; and an oscillation-inducing structure (e.g., 114) for causing the fluid issued from said outlet to cyclically sweep back and forth, said oscillation-inducing structure comprising a structural surface disposed in the fluid's flow path and responsive to said fluid from said inlet impinging thereon for establishing alternating vortices in said fluid at side-by-side locations downstream of said surface means; and (c) an eddy filter structure (e.g., 100) in at least one of said fluid oscillator's fluid flow path and proximate said fluid oscillator's inlet and responsive to said fluid to reduce the adverse effects of turbulence in said manifold fluid.

Another way of characterizing the apparatus of the present invention is as a showerhead or nozzle assembly 30 adapted for use with a fluid inlet which pressurizes a manifold 40 supplying fluid for spraying, comprising:

a plurality of fluidic oscillators (e.g., 110), each oscillator having a body member with top, bottom, side, front and rear outer surfaces, each oscillator having a fluidic circuit embedded in said top surface, said circuit forming a path in which a fluid may flow through said oscillator, each said fluidic circuit having a fluid inlet (e.g., 111) in fluid communication with the manifold's fluid supply, a power nozzle, an interaction chamber (e.g., 113) and an outlet (e.g., 112) in said front surface from which the fluid may be sprayed from said oscillator, and wherein said oscillators are configured with an eddy filter structure (e.g., 100 or 200 or 300) upstream from and proximate said fluidic circuit's fluid inlet and responsive to said fluid supply to reduce the adverse effects of turbulence in said manifold's fluid supply.

Having described preferred embodiments of a new and improved structure and method, it is believed that other modifications, variations and changes will be suggested to those skilled in the art in view of the teachings set forth herein. It is therefore to be understood that all such variations, modifications and changes are believed to fall within the scope of the present invention as set forth in the following claims.

What is claimed is:

1. A showerhead or nozzle assembly for use with a manifold supplying fluid, comprising:

(a) a manifold configured to receive pressurized fluid via a fluid supply inlet having an inlet diameter, said manifold including an open interior volume defined by a tortuous path having a length and a laterally extending width wherein said laterally extending width is greater than said length, said open interior volume which is pressurized with inward and distally flowing fluid, wherein said inward flowing fluid flows laterally within said interior volume creating turbulent eddies within said interior volume, said turbulent eddies extending laterally from said fluid supply inlet, said manifold being bounded by a perforated rain-can shaped front face defining a plurality of laterally spaced, substantially parallel channels or throughbores configured to permit fluid to flow distally or forwardly therethrough; and (b) a plurality of fluidic oscillators, each oscillator having a body member with top, bottom, side, front and rear outer surfaces, each oscillator having a fluidic circuit embedded in said top surface forming a path in which a fluid flows through said oscillator, each said fluidic circuit having a fluid inlet in fluid communication with the manifold's fluid supply inlet via said open interior volume, a power nozzle having a width dimension, an interaction chamber, and an outlet in said front surface from which the fluid is sprayed from said oscillator, wherein said oscillators are configured with an eddy filter structure upstream from said fluidic circuit's fluid inlet and responsive to said fluid supply to reduce the adverse effects of said turbulent eddies from said manifold's open interior volume on the generation of oscillating sprays, wherein said eddy filter structure comprises:

a first aligned array of filter posts which project inwardly into the fluid's flow path, wherein said first aligned array of filter posts are evenly spaced at an inter-post gap dimension "a" of about one millimeter, a second aligned array of filter posts which project inwardly into the fluid's flow path, wherein said second aligned array of filter posts are spaced at said inter-post gap dimension "a" of about one millimeter behind said first aligned array of filter posts and offset such that a space between adjacent filter posts in said first aligned array is centered on a central axis of a filter post in the second array, and wherein the inter gap-post gap dimension "a" is less than the power nozzle's width dimension to ensure that filtered turbulent eddies are smaller than the power nozzle width dimension.

2. The showerhead or nozzle assembly of claim 1, wherein said eddy filter structure's first aligned array of posts comprises an upstream row of posts and said second aligned array of posts comprises a downstream row of posts spaced from said first row of posts by an inter-row spacing "b".

3. The showerhead or nozzle assembly of claim 2, wherein said eddy filter structure's inter-row spacing "b" is about one millimeter.

4. The showerhead or nozzle assembly of claim 3, wherein said inter post spacing "a" and inter row spacing "b" define openings that are each less than half the power nozzle's width, and wherein said eddy filter's configuration ensures that filtered turbulent eddies are smaller than the power nozzle width dimension, whereby the nozzle performs reliably and correctly with a desired spray fan angle.

5. The showerhead or nozzle assembly of claim 4, wherein the desired spray fan angle is 18 degrees.

6. The showerhead or nozzle assembly of claim 1, wherein each oscillator has an island obstacle disposed in the fluid flow path formed by said fluidic circuit which is responsive to the fluid flowing from the fluid inlet and impinging thereon for establishing alternating vortices in said fluid.

7. The showerhead or nozzle assembly of claim 1, wherein said perforated rain-can shaped front face includes a diameter of about 4 to 8 inches and said a plurality of fluidic oscillators are positioned within a plurality of throughbores arrayed upon said rain-can shaped front face at different radial distances from a central axis.

8. The showerhead or nozzle assembly of claim 1, wherein said second aligned array of filter posts is position distally from said first aligned array of filter posts wherein said first aligned array of filter posts includes a greater number of filter posts than said second aligned array of filter posts.

9. The showerhead or nozzle assembly of claim 1, further comprising at least one inwardly projecting wall that extends within the tortuous path.

10. The showerhead or nozzle assembly of claim 9, wherein said inwardly projecting wall extends from the rain-can shaped front face.

11. The showerhead or nozzle assembly of claim 9, wherein said inwardly projecting wall extends from the manifold.

12. The showerhead or nozzle assembly of claim 1, wherein said manifold further comprises a pivoting ball joint to allow the nozzle assembly to be aimed.

13. A rain-can style showerhead assembly, comprising:

(a) a manifold configured with a central flow inlet having a central inlet diameter to receive pressurized fluid, said manifold including an open interior volume defined by a tortuous path having a length and a laterally extending width wherein said laterally extending width is greater than said length, said open interior volume which is pressurized with inward flowing fluid from said central flow inlet which creates turbulent eddies within said flowing fluid, said turbulent eddies extending laterally from said central flow inlet, said manifold's interior volume being bounded distally by a perforated rain-can showerhead shaped front face defining a plurality of channels or throughbores configured to permit fluid to flow distally or forwardly therethrough;

(b) a plurality of fluid oscillators, each being configured to be received within and in fluid communication with said front manifold's face channels or throughbores, wherein each fluid oscillator has a body member with a chamber therein, said chamber having a fluid inlet for receiving turbulent manifold fluid under pressure from said manifold's interior volume and admitting said fluid into said chamber and a fluid outlet for issuing pressurized fluid from said chamber forwardly and into an ambient environment, said inlet and outlet defining a flow path therebetween for flow of fluid through said chamber; and an oscillation-inducing structure for causing the fluid issued from said fluid oscillator's outlet to cyclically sweep back and forth, said oscillation-inducing structure comprising a structural surface disposed in the fluid's flow path and responsive to said fluid from said inlet impinging thereon for establishing alternating vortices in said fluid, where said fluid is accelerated in a power nozzle upstream of said outlet;

wherein said power nozzle has a power nozzle width dimension and a power nozzle depth dimension, and (c) an eddy filter structure in at least one of said fluid oscillator's fluid flow path and in fluid communication with said fluid oscillator's inlet and responsive to said fluid to reduce the adverse effects of turbulence in said manifold fluid, wherein said eddy filter structure comprises:

a first aligned array of filter posts which project inwardly into the fluid's flow path, wherein said first aligned array of filter posts are evenly spaced at an inter-post gap dimension "a" of about one millimeter, a second aligned array of filter posts which project inwardly into the fluid's flow path, wherein said second aligned array of filter posts are spaced at said inter-post gap dimension "a" of about one millimeter behind said first aligned array of filter posts and offset such that a space between adjacent filter posts in said first aligned array is centered on a central axis of a filter post in the second array, and wherein the inter gap-post gap dimension "a" is less than the power nozzle's width dimension to ensure that filtered turbulent eddies are smaller than the power nozzle width dimension.

14. The rain-can style showerhead assembly of claim 13, wherein said eddy filter structure's first aligned array of posts comprises an upstream row of posts and said second aligned array of posts comprises a downstream row of posts spaced from said first row of posts by an inter-row spacing "b".

15. The rain-can style showerhead assembly of claim 14, wherein said eddy filter structure's inter-row spacing "b" is about one millimeter.

16. The rain-can style showerhead assembly of claim 15, wherein said inter post spacing "a" and inter row spacing "b" define openings that are each less than half the power nozzle's width dimension, and wherein said eddy filter's configuration ensures that filtered turbulent eddies are smaller than the power nozzle width dimension, whereby the nozzle performs reliably and correctly with a desired spray fan angle of approximately 18 degrees.

17. The rain-can style showerhead assembly of claim 15, wherein said inter post spacing "a" and inter row spacing "b" define openings that are each less than half the power nozzle's depth dimension, and wherein said eddy filter's configuration ensures that filtered turbulent eddies are smaller than the power nozzle depth dimension, whereby the nozzle performs reliably and correctly with a desired spray fan angle of approximately 18 degrees.

18. The rain-can style showerhead assembly of claim 13, wherein said eddy filter's inter post spacing "a" is less than half the power nozzle's width dimension, wherein said eddy filter's configuration ensures that filtered turbulent eddies are smaller than the power nozzle width dimension, whereby the nozzle performs reliably and correctly.

* * * * *